United States Patent [19]

Schmoll

[11] Patent Number: 4,791,794

[45] Date of Patent: Dec. 20, 1988

[54] LATCH NEEDLE FOR STITCH FORMING TEXTILE MACHINES

[75] Inventor: Wolfgang Schmoll, Haigerloch-Owingen, Fed. Rep. of Germany

[73] Assignee: Theodor Groz & Söhne & Ernst Beckert Nadelfabrik Commandit-Gesellschaft, Albstadt-Ebingen, Fed. Rep. of Germany

[21] Appl. No.: 146,699

[22] Filed: Jan. 21, 1988

[30] Foreign Application Priority Data

Jan. 24, 1987 [DE] Fed. Rep. of Germany ..... 3702019

[51] Int. Cl.[4] ..... D04B 35/04

[52] U.S. Cl. ..... 66/121; 66/123

[58] Field of Search ..... 66/121, 123, 116, 117

[56] References Cited

U.S. PATENT DOCUMENTS

| | | | |
|---|---|---|---|
| 1,732,469 | 10/1924 | Hague | 66/117 |
| 1,764,406 | 6/1930 | Hohmann | 66/121 |
| 1,780,790 | 11/1930 | Leavin et al. | 66/121 |
| 1,823,906 | 9/1931 | Leavin et al. | 66/117 |
| 3,050,968 | 8/1962 | Masujima | 66/121 |
| 3,222,891 | 12/1965 | Wignall | 66/121 |

FOREIGN PATENT DOCUMENTS

| | | | |
|---|---|---|---|
| 202681 | 9/1958 | Austria | 66/121 |
| 60605 | 6/1891 | Fed. Rep. of Germany . | |
| 664110 | 10/1929 | Fed. Rep. of Germany . | |
| 1113537 | 9/1961 | Fed. Rep. of Germany . | |
| 1410312 | 4/1969 | Fed. Rep. of Germany | 66/121 |
| 2650985 | 5/1977 | Fed. Rep. of Germany . | |
| 49-13944 | 4/1974 | Japan | 66/121 |
| 24311 | of 1893 | United Kingdom | 66/121 |

*Primary Examiner*—Ronald Feldbaum
*Attorney, Agent, or Firm*—Spencer & Frank

[57] ABSTRACT

A latch needle having an elongated spring element, one end thereof attached to the bottom of a recess in one portion of the slot, the other end of said spring element bearing on the extended end portion of the latch biasing the latch to a partially open position.

9 Claims, 3 Drawing Sheets

LATCH NEEDLE FOR STITCH FORMING TEXTILE MACHINES

BACKGROUND OF THE INVENTION

1. Field of the Invention

The present invention relates to a latch needle for stitch forming textile machines. The latch needle includes a needle shank and a needle hook following the end of the shank. A latch slot is formed in the needle shank and extends in the longitudinal direction of the needle. A latch is also mounted on an axle in the latch slot at a location so as to be pivotal about a transversely extending pivot axis. The latch is provided on one end with a latch spoon which cooperates with the needle hook when the latch is in the closed position. The latch has an end portion which extends from the region of a latch blade or stem near the axle to the end facing away from the latch spoon. The needle shank includes a groove-like depression following the latch slot which extends toward the end facing away from the needle hook. One end of an elongate spring element is anchored in the groove-like depression while he other end of the spring element projects into the latch slot. When the needle latch is in the closed position the spring element passes over an associated contact face at one end of the latch stem. The spring element is positioned and the end of the latch stem is shaped so that there is a partially open intermediate position in which the axis of the latch stem and the axis of the needle shank define an angle which is preferably less than 90°.

2. Discussion of the Prior Art

Latch needles whose latches can be held in a partially open intermediate position by an associated spring element have in the past been used exclusively in hand knitting machines. When casting on loops, i.e. at the beginning of the knitting process or when forming further stitches, the partially open intermediate position of the latch makes it possible to unimpededly place the yarn into the needle hook. The partially open intermediate position avoids the necessity of using a brush-shaped needle opener or of initially opening all needle latches by hand. Both of these methods for opening the latch are connected with a considerable amount of work.

Attempts have been made to employ latch needles which have spring tensioned latches in knitting machines, and in particular in flat frame knitting machines. These needles would take the place of the previously employed normal latch needles having freely pivotally mounted latches. The reason for this is that the us of these normally employed latch needles (particularly when they are configured as stitch transfer needles) involves the danger that when the needle is retracted the latch does not properly pivot into its closed position and the stitch becomes caught at the tip of the open needle latch. The result of improper closing is that the yarn becomes snagged or split open. The reason this happens is because the stitch has been widened by the transfer spring of the transfer needle and the stitch is not pulled beneath the completely opened needle latch. This causes improper pivoting as the needle is retracted. Another problem that may happen is that the stitch slides over the open latch and is then caught in the needle hook. All of these possibilities result in faulty merchandise and the possibility of these flaws occurring increases when several yarns are knit simultaneously or when coarse natural yarns are processed.

Attempts to avoid this source of flaws by the use of latch needles having spring tensioned latches have been only partially successful. This is because a specific spring force is required to bring the latch from its closed or its completely open position into the partially open intermediate position and t arrest it there elastically. In prior art latch needles of this type, the force exerted on the latch by the spring element produces a great amount of friction for the latch which results in making the movement of the latch sluggish. Over time this affects the brush-shaped latch openers of the knitting machine in a manner such that the latches will no longer open reliably. At the same time, the end portion of the latch stem as well as the spring element experience wear from the constant friction at the spring element. The wear that occurs at the latch stem end causes the latch edges to become rounder after a longer period of operation and the wear of the spring element causes a reduction in the spring force. Thus the time period during which the pivoting movement of the latch is performed also becomes irregular in length because of the irregular friction conditions. These irregular conditions lead to an irregular appearance of the stitches in the knit fabric.

Such a latch needle that is intended for a hand knitting machine and that is unsuitable in principle for fast running flat frame knitting machines is disclosed in German Pat. No. 1,113,537. This needle has the latch slot located below the needle latch and is provided with a steel wire spring underneath the needle latch which is placed loosely into upwardly open steps at both ends of the latch slot so that the spring is undisplaceable in the longitudinal and transverse directions. Two flattened portions attached to the end portion of the latch stem cause the latch to be pressed back into a partially open intermediate position after each opening an closing movement in which position the axis of the needle latch and the axis of the needle shank form an angle of about 45° with one another.

Such needles are very well suited for manually operated flat frame knitting machines where the above-mentioned drawbacks do not occur because, compared to a modern flat frame knitting machine, the knitting speed is extremely slow and the spring force of the spring inserted underneath the latch can be kept correspondingly low.

This also applies to another latch needle known in practice for hand knitting machines which has a spring tensioned latch. In this needle, the latch is pivoted back after every closing or opening movement into an approximately half-open intermediate position by means of a spring element configured as a circular, flat or square spring element. In this intermediate position, the axis of the needle latch and the axis of the needle shank form an angle of approximately 90° with one another. One end of the spring element is braced into a groove made in the upper side of the needle shank and the groove opens into the latch slot. In the mentioned half-open intermediate position when the latch is to an angle of about 90°, the free end of the spring element, which extends into the latch slot, presses against the upper side of the latch stem where the latter is essentially linear. If the latch is pivoted by the newly formed stitch from this intermediate position back into its completely open position, the upper side of the latch stem presses the freely movable front portion of the spring element downward. After the stitch has slid onto the needle shank and has released the latch, the spring element is able to pivot the latch back into the intermediate position in which the latch is elastically locked by the free end of the spring element which has returned to its starting position.

When the needle is retracted and the stitch hanging on the needle shank moves in the direction of the needle hook, the stitch grips the latch in its intermediate position and pivots the stitch until the latch spoon rests on the hook as the needle continues to retract. Therefore the needle reaches its closed position. During this latch pivoting movement the free end of the spring element is in constant engagement with the latch stem. As the latch pivots, the free end of the spring element travels on a contact face of the end portion of the latch stem. It travels from the region of the latch bearing to the vicinity of the frontal face of the latch stem end portion. While this occurs the spring element is simultaneously pressed upwardly and is thus tensioned. After the stitch has been knitted the latch is released thus enabling the spring element which acts on the contact face of the latch stem to pivot the latch back into its intermediate position.

Attempts to use these latch needles which are intended exclusively for us in hand knitting machines in fast running flat frame knitting machines failed. They have failed because the structure of the knit fabric turned out to be so irregular that the merchandise could not be used. As far as it is known, the reason for this is the sluggish movement of the latch and the fluctuating tension forces to which the stitch is subjected to because of the irregular pivoting movements of the latch.

SUMMARY OF THE INVENTION

It is therefore a object of the present invention to provide a latch needle having a latch which can be pivoted by an associated spring element into a partially open intermediate position so that such a needle can also be used for high operating speeds and is distinguished by accurate operation for the production of a uniform knit structure and by a long service life.

This is accomplished by a latch needle where the end portion of the latch stem is provided with a free surface which opens into the upper side or the end portion of the latch stem and releases the latch when the stem is pivoted from its intermediate position in the direction toward its completely open position. During this pivoting movement, this free surface extends at a distance from the frontal face of the spring element which is otherwise out of engagement with the end portion of the latch stem.

With this configuration of the latch, the spring element is in engagement with the end portion of the latch stem only as long as the latch takes on a position within the pivoting range between the stem's closed position and its intermediate position. The remaining pivoting range of the latch, from its intermediate position to its completely open position, is completely decoupled from the spring element. This allows the latch to be freely movable until a position shortly before the completely open position where the upper side of the latch shaft places itself onto the spring element. Then the newly formed stitch slides over the latch and presses the spring element downward thereby slightly tensioning the latch. After the stitch has released the latch during the further course of the needle retraction movement, the tensioned spring element pivots the latch back into its intermediate position where it is held by the spring element which grips over the contact face at the end portion of the latch stem.

Due to the fact that the latch is freely pivotable over a major portion of its pivoting range a low frictional stress on the part of the spring element results for the latch bearing. Also the wear occurring at the latch portions which come into engagement with the spring element is reduced to a minimum even at high operating speeds. Because the latch is freely movable over the major portion of its pivoting range and needs to be depressed by the stitch against the spring force only in the last part of the pivoting range high uniformity of the stitches is achieved.

The use of the novel latch needle in high-speed flat frame knitting machines has the advantage that it allows the distance between the tip of the closed latch and the outside radius of the hook to be omitted due to the automatic opening of the latches from their closed position. By eliminating this "latch projection", the formation of finer stitches is permitted. Since the latch is initially pivoted from its completely open position toward its closed position not by the stitch but by the spring element, the latch can be placed very flat on then needle shank or can even be completely buried in the needle shank, in its completely open position so that even tight and firm stitches can be pulled effortlessly over the open latch. This improves the quality of the merchandise.

The end portion of the needle shank is advantageously provided with a recess starting at the upper side of the shank with the edges of the recess forming at least the free surface. In a preferred embodiment, the arrangement may be such that the recess is disposed between the following regions: the region of the bearing location and the frontal face of the end portion of the latch stem and is delimited by the free surface which ends at the upper side and by the contact face starting at the frontal face.

The contact face may be disposed on, below or above the longitudinal center plane of the latch which passes through the center of the axle and may be oriented at least approximately parallel to this plane. Moreover, the mentioned recess may have a surface that forms an obtuse angle or may essentially be circular, concave and/or convex shaped.

It is advantageous if the end portion of the latch stem and the end of the spring element are held in the latch slot for each position of the latch within its pivoting range. This excludes interference with the sliding movement of the newly formed stitch over the opening latch due to elements projecting from the rear of the needle shank.

This feature is in contrast to conditions existing with some of the prior art discussed above.

DESCRIPTION OF THE PREFERRED EMBODIMENTS

Figure 1:
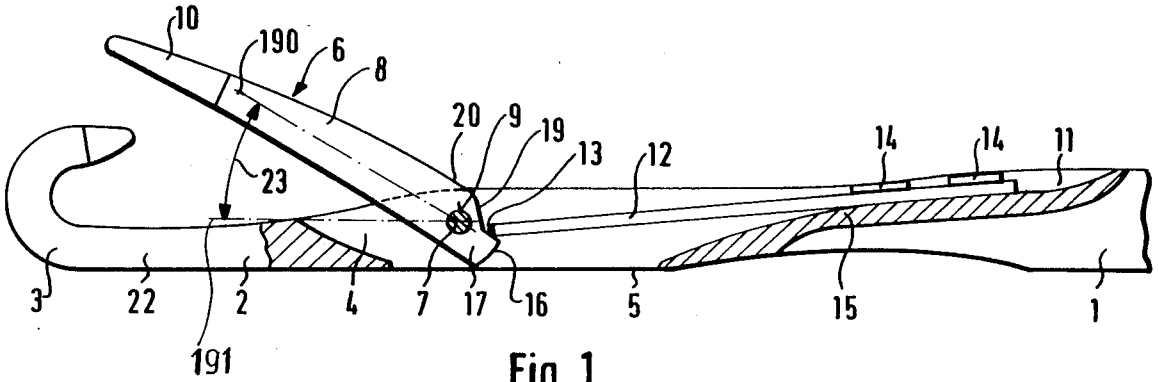
FIGS. 1 to 3 illustrate the latch needle according to the present invention in a longitudinal sectional view showing the latch in three different positions.

The latch needle comprises a needle shank 1 which may have a butt (not shown) and which is followed by a needle cheek 2 and a needle hook 3. The needle shank 1 has a rectangular cross section and is provided with a latch slot 4 which extends in the longitudinal direction of the needle shank. The slot 4 starts from the upper side of the needle shank and extends toward the underside of the needle shank in such a manner that an opening 5 is created on the underside of the needle shank to permit lint to be discharged.

Within latch slot 4, a latch 6 is mounted in a bearing location so that the latch 6 is pivotal around a transversely extending axle or shaft 7. Latch 6 includes a latch blade or stem 8 provided with a bearing bore 9 which cooperates with axle 7 at the bearing location and is provided at its end with a latch spoon 10 which cooperates with needle hook 3 when the latch is in the closed position.

Extending from latch slot 4, a groove-like depression 11 is formed in needle shank 1 which ends at the upper side of the needle shank. The depression 11 extends in the longitudinal direction of the needle shank and has one end of an elongate spring element 12 anchored therein. The other end 13 of the spring element 12 projects into latch slot 4. Spring element 12, which is shown as a straight piece of spring wire, may also be a circular, flat or rectangular spring. The spring element 12 may also be linear, curved or angled to meet the intended purpose. At point 14, the end of spring element 12 is firmly braced into recess 11. The bottom 15 of recess 11 has a gentle slope toward the underside of the needle shank so that the end 13 of spring element 12 which is disposed in latch slot 4 can move up and down without interference.

Between the region of the bearing location 9 and the frontal face 16 of the latch 6 facing away from spoon 10, latch 6 has an extended end portion 17 such that latch 6 forms a double-arm lever which is pivotally mounted on axle 7. At end portion 17, a short contact face 18 is formed which starts at frontal face 16 and extends essentially parallel to and slightly above the longitudinal center plane 190 of latch 6. Contact face 18 is adjacent a free surface 19 which opens on the upper side 20 of latch stem 8. Both faces 18, 19 thus together define a recess 21 which extends in end portion 17 of needle shank 8 from upper side 20 to frontal face 16 and lies between the region of bearing location 9 and frontal face 16.

The free surface 19 may essentially have the shape of a circle segment or may be concave or convex. As an alternative, it may also be shaped of straight sections having softly rounded transitions at their ends as presently illustrated.

The length of spring element 12 is selected so that when latch 6 is in the closed position and latch spoon 10 is resting on needle hook 3, the end 13 of the spring element 12, passes over contact face 18 of end portion 17 of the latch stem. In this position, the end 13 of spring element 12 is simultaneously raised upwardly compared to the untensioned state shown in FIG. 1 thereby tensioning spring element 12.

The operation of the latch needle will now be described starting with the latch 6 in the closed position. When latch 6 is released from the closed position by a stitch (not shown), spring element 12 acts on contact face 18, moves latch 6 into the partially open intermediate position shown in FIG. 1. In this position the longitudinal center axis 190 of latch 6 and the axis 191 of needle shank 1 form an angle 23 with one another which is about 30° but in any case is less than 90°. Latch 6 is pivoted into this intermediate position by spring element 12.

Figure 2:
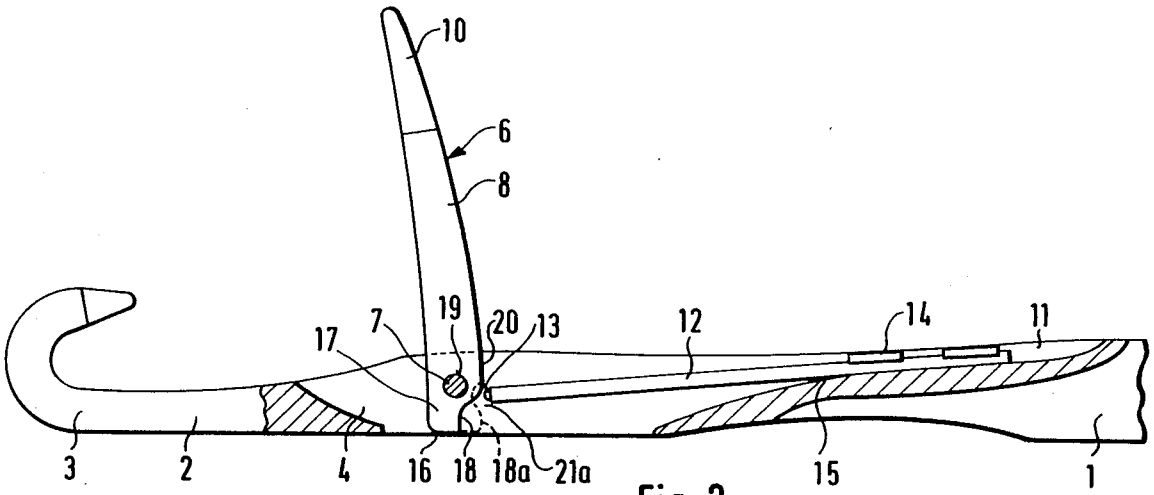

In the course of forward movement of the latch needle, the stitch hanging in needle hook 3 moves onto latch 6 and pivots it clockwise with respect to FIG. 1. This moves latch 6 from the partially open intermediate position. At a certain point of pivoting, the end 13 of spring element 12 ceases to be in contact with contact face 18 and becomes positioned adjacent free surface 19 without contacting it. The free surface 19 is at a predetermined distance from the end 13 of spring element 12 as shown in FIG. 2. Latch 6 is therefore able to perform its pivoting movement without interference from the intermediate position to the completely open position shown in FIG. 3 without being influenced therein by spring element 12. Only at the end of this pivoting movement does the back of latch stem 8 of latch 6 contact spring element 12. Continued movement by the latch stem causes the spring element 12 to bend slightly downward by the stitch pressing onto the open latch until latch 6 reaches its end position shown in FIG. 3.

As soon as the stitch releases latch 6 in the course of the further forward movement of the latch needle, spring element 12, returns to its starting position shown in FIG. 1. This pivots latch 6 counterclockwise back to the intermediate position shown in FIG. 1 in which it is held by end 13 of spring element 12 which acts on contact face 18.

The free surface 19 which releases latch 6 from spring element 12 when the latch 6 pivots from the intermediate position shown in FIG. 1 toward the completely open position need not necessarily define a cutout-like, obtuse-angled recess in end portion 17 of the latch stem as described in connection with the drawing figures. Embodiments are also conceivable in which the recess has a circular shape as indicated by the dashed lines **21*a* in FIG. 2. Recess 21*a* is then disposed in the region of the upper side 20 of latch stem 8 or, more precisely, in the region of its end portion 17, on which also rests contact face 18*a* which is adjacent to frontal face 16. Of course, the circle segment-like recess 21*a* may also be combined in the lower contact face 18 in such a manner that it follows contact face 18. Finally, it is also not absolutely necessary for contact face 18** to be a planar surface. It may be a curved surface or form part of a semicircular recess.

Figure 3:
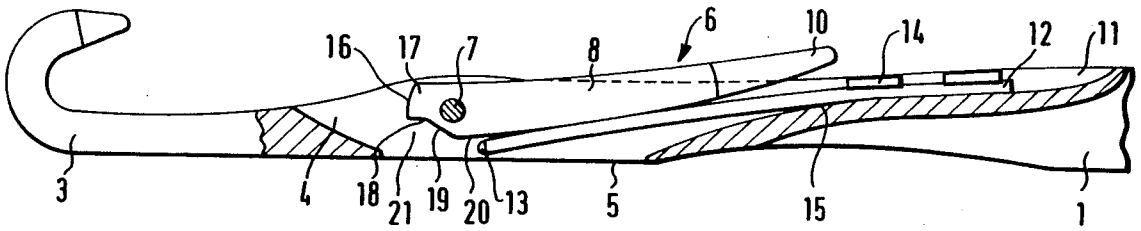

As can be seen in FIGS. 1 to 3, end portion 17 of latch stem 8 and end 13 of spring element 12 are dimensioned and arranged in such a manner that in every position of latch 6 within its pivoting range, end portion 17 and end 13 of spring element 12 remain in the latch slot. In other words they do not project downwardly from opening 5. In this way a newly formed stitch sliding over the opening latch 6 is not impaired. Therefore, the loop of the old stitch hanging from this new stitch is not caught by projecting portions on the rear of the needle shank.

The present disclosure relates to the subject matter disclosed in the Federal Republic of Germany, No. P 37 02 019.6, Jan. 24, 1987, the entire specification of which is incorporated herein by reference.

It will be understood that the above description of the present invention is susceptible to various modifications, changes and adaptations, and the same are intended to be comprehended within the meaning and range of equivalents of the appended claims.

I claim:

1. A latch needle for stitch forming textile machines, wherein said needle has a longitudinal direction and comprises:

a needle shank having first and second ends, said needle shank having a latch slot formed therein extending in the longitudinal direction, said latch slot including a bearing location, said needle shank having a transversely extending pivot axis at said bearing location, and said needle shank further having a groove-like depression which extends from said latch slot toward said second end;

a needle hook attached to said first end of said shank;

a latch having first and second portions and first and second ends, said latch being pivotally mounted in said latch slot so that said latch is pivotal around the transversely extending pivot axis, said latch including a latch spoon in said first portion located to cooperate with said needle hook, said first portion of said latch extending from a position adjacent said bearing location to said first end of said latch and said second portion of said latch extending from said position adjacent said bearing location to said second end of said latch, said latch further having an upper face, a frontal face, a contact surface, and a contact-free surface, wherein said frontal face, said contact surface and said contact-free surface are all disposed in said second portion of said latch, said frontal face is disposed at said second end of said, latch, and said contact surface and said contact-free surface are disposed between said frontal face and said upper surface; and an elongate spring element having first and second ends, wherein said first end is attached to said needle shank in said groove-like depression and said second and is freely disposed in said latch slot;

and wherein said latch is movable between a closed position in which said latch spoon cooperates with said needle hook and said second end of said spring element contacts said contact surface and said spring element biases said latch in a first pivoting direction, a completely open position in which said upper face of said latch engages said spring element and said spring element biases said latch in a second pivoting direction opposite to said first pivoting direction, and an intermediate position which is between said closed position and said completely open position, said intermediate position being defined as the position where said second end of said spring element contacts said contact surface, but said spring element no longer biases said latch, whereby said latch is freely pivotable from said intermediate position toward said completely open position until its upper face comes into contact with said spring element.

2. A latch needle according to claim 1, wherein said second portion of said latch is formed to have a recess which begins at said upper face of said latch and is bounded by said contact-free surface.

3. A latch needle according to claim 2, wherein said recess is disposed between said bearing location and said frontal face and is defined by said contact-free surface and said contact surface.

4. A latch needle according to claim 2, wherein said latch has a longitudinal axis and said contact face is oriented at least approximately parallel the longitudinal axis of said latch.

5. A latch needle according to claim 2, wherein said recess is defined by two surfaces which form an obtuse angle.

6. A latch needle according to claim 2, wherein said recess is configured to have an essentially circular segment shape.

7. A latch needle according to claim 1, wherein said contact-free surface is configured to have a circular segment shape.

8. A latch needle according to claim 1, wherein said contact-free surface is configured to have at least one of a concave or convex configuration.

9. A latch needle according to claim 1, wherein, when said latch is disposed in said intermediate position, the longitudinal center axis of said latch and the longitudinal axis of said needle shank form an angle with one another which is less than 90°.

* * * * *